US011041627B1

(12) United States Patent
Amlin

(10) Patent No.: US 11,041,627 B1
(45) Date of Patent: Jun. 22, 2021

(54) COMBUSTION GRATE FOR A PELLET STOVE

(71) Applicant: Sun Mountain Stove Works Inc., Creswell, OR (US)

(72) Inventor: William K. Amlin, Creswell, OR (US)

(73) Assignee: SUN MOUNTAIN STOVE WORKS INC., Creswell, OR (US)

( * ) Notice: Subject to any disclaimer, the term of this patent is extended or adjusted under 35 U.S.C. 154(b) by 0 days.

(21) Appl. No.: 17/067,674

(22) Filed: Oct. 10, 2020

(51) Int. Cl.

| | |
|---|---|
| ***F24B 13/02*** | (2006.01) |
| ***F24B 5/02*** | (2006.01) |
| ***F24B 1/02*** | (2006.01) |
| ***F23H 5/00*** | (2006.01) |

(52) U.S. Cl.
CPC ..... *F24B 13/02* (2013.01); *F23H 5/00* (2013.01); *F24B 1/024* (2013.01); *F24B 1/026* (2013.01); *F24B 5/026* (2013.01); *F23G 2202/10* (2013.01)

(58) Field of Classification Search
CPC ..... F24B 13/02; F24B 5/026; F24B 1/024; F23H 5/00; F23G 2202/10
See application file for complete search history.

(56) References Cited

U.S. PATENT DOCUMENTS

| | | | | |
|---|---|---|---|---|
| 2,157,195 A | | 5/1939 | Weeks | |
| 4,226,195 A | * | 10/1980 | Lindroos | F24H 1/26 110/234 |
| 4,320,738 A | | 3/1982 | Johnson | |
| 5,295,474 A | * | 3/1994 | Whitfield | F23B 1/00 110/293 |
| 5,383,446 A | * | 1/1995 | Whitfield | F23B 1/00 110/110 |
| 5,488,943 A | * | 2/1996 | Whitfield | F23B 1/00 126/152 B |
| 5,617,841 A | * | 4/1997 | Whitfield | F23B 1/00 126/152 B |
| 5,893,358 A | * | 4/1999 | Whitfield | F23L 15/00 126/73 |
| 7,861,707 B2 | * | 1/2011 | Wisener | F23B 50/00 126/68 |
| 9,995,489 B2 | * | 6/2018 | Amlin | F23B 80/04 |
| 10,731,863 B2 | * | 8/2020 | Broersma | F24B 5/028 |
| 2007/0186920 A1 | | 8/2007 | Wisener | |
| 2008/0066731 A1 | | 3/2008 | Johnson | |
| 2011/0072722 A1 | * | 3/2011 | Young | F23G 5/002 48/87 |

* cited by examiner

*Primary Examiner* — David J Laux
(74) *Attorney, Agent, or Firm* — David S. Alavi

(57) ABSTRACT

A combustion assembly housing contains primary and secondary combustion chambers and an ash receptacle. The primary combustion chamber has primary and exhaust grates. Fuel pellets fall in downward onto the primary grate; intake air flows in upward through the primary grate; exhaust gas flows out rearward through the exhaust grate. The primary grate supports unburned fuel pellets and permits partially burned pellets to fall through. Multiple vertical passages through the primary grate are each deeper than they are wide. The secondary combustion chamber has a secondary grate. Partially burned pellets fall in downward onto the secondary grate; intake air flows in rearward, through the secondary grate, and out upward into the primary combustion chamber. The secondary grate supports partially burned pellets and permits ash to fall through downward into the ash receptacle. Intake air flows rearward into the ash receptacle and upward into the secondary combustion chamber.

20 Claims, 6 Drawing Sheets

FIG. 2C
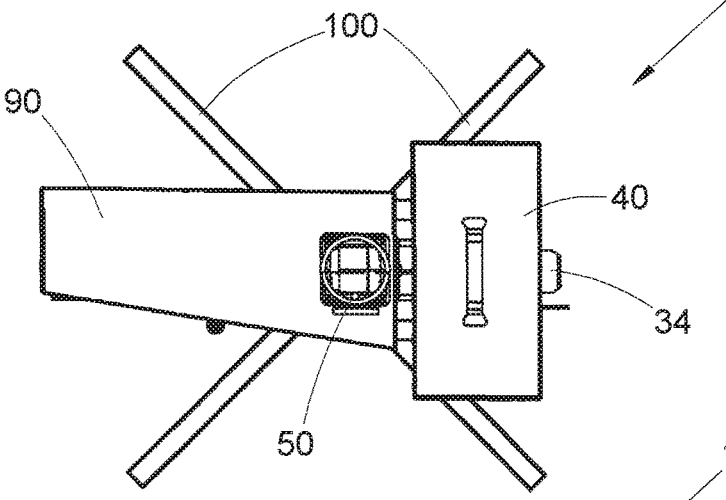
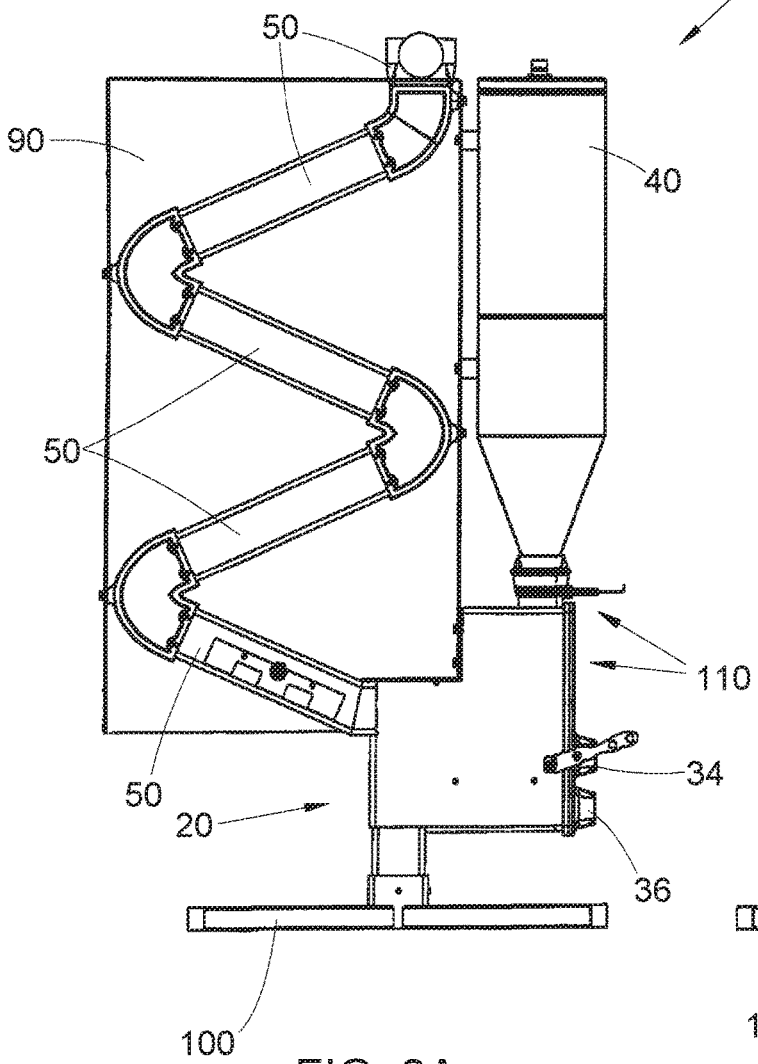
FIG. 2A
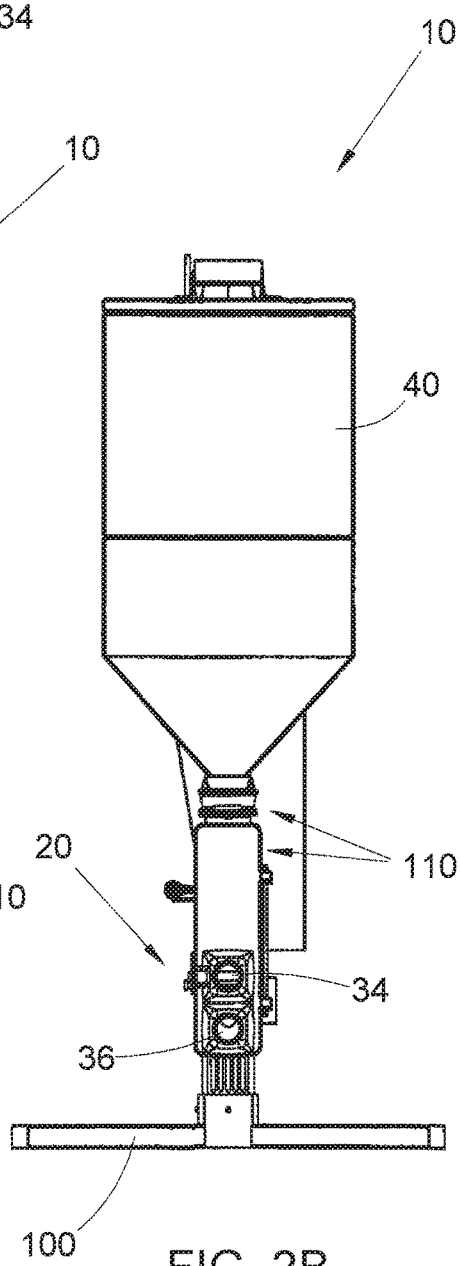
FIG. 2B

COMBUSTION GRATE FOR A PELLET STOVE

FIELD OF THE INVENTION

The field of the present invention relates to pellet stoves. In particular, a combustion grate for a pellet stove is shown and described.

BACKGROUND

Some previous examples of a stove are described in:

U.S. Pat. No. 2,157,195 entitled "Furnace and combustion chamber" issued May 9, 1939 to Weeks;

U.S. Pat. No. 4,226,195 entitled "Water heating stove" issued Oct. 7, 1980 to Lindroos;

U.S. Pat. No. 4,320,738 entitled "Heating stove" issued Mar. 23, 1982 to Johnson;

U.S. Pat. No. 5,295,474 entitled "Combustion grate with rods for pellet fueled stove" issued Mar. 22, 1994 to Whitfield et al;

U.S. Pat. No. 5,383,446 entitled "Self concentrating combustion grate for pellet fueled stoves" issued Jan. 24, 1995 to Whitfield;

U.S. Pat. No. 5,488,943 entitled "Self-distributing combustion grate for pellet fueled stoves" issued Feb. 6, 1996 to Whitfield et al;

U.S. Pat. No. 5,893,358 entitled "Pellet fuel burner for heating and drying systems" issued Apr. 13, 1999 to Whitfield;

U.S. Pat. Pub. No. 2007/0186920 entitled "Gravity feed natural draft pellet stove" published Aug. 16, 2007 in the name of Wisener;

U.S. Pat. Pub. No. 2008/0066731 entitled "Biomass pellet fuel heating device, system and method" published Mar. 20, 2008 in the name of Johnson;

U.S. Pat. No. 7,861,707 entitled "Gravity feed natural draft pellet stove" issued Jan. 4, 2011 to Wisener; and U.S. Pat. No. 9,995,489 entitled "Pellet stove" issued Jun. 12, 2018 to Amlin.

Each one of said patents and publications are incorporated by reference in its entirety.

SUMMARY

An inventive apparatus comprises a primary combustion chamber including a primary grate and an exhaust grate. The primary combustion chamber has a top opening, a bottom opening at least partly obstructed by the primary grate, and a rear opening at least partly obstructed by the exhaust grate. Fuel pellets can fall downward through the top opening into the primary combustion chamber onto the primary grate; intake air can flow upward into the primary combustion chamber through the bottom opening and the primary grate; exhaust gas can flow rearward out of the primary combustion chamber through the exhaust grate and the rear opening. The primary grate supports the fuel pellets before partial combustion thereof and permits partially combusted fuel pellets to fall through the primary grate. The primary grate defines a primary grate surface with multiple vertical primary grate passages through the primary grate; each primary grate passage is smaller in at least one transverse passage dimension than its vertical depth. The primary grate can be arranged as multiple elongated primary grate members arranged in a generally horizontal, generally parallel, spaced-apart arrangement so that the vertical primary grate passages are arranged as multiple parallel elongated primary slots; each primary slot is vertically deeper than its width. The elongated slots can be arranged in a generally forward-to-rearward orientation.

An inventive apparatus can further include a combustion assembly housing, a secondary combustion chamber, and an ash receptacle. The combustion assembly housing has a forward intake end and a rearward exhaust end. The primary combustion chamber is positioned within the combustion assembly housing. The secondary combustion chamber is positioned within the combustion assembly housing below the primary combustion chamber and has a secondary grate. The ash receptacle is positioned within the combustion assembly housing below the secondary combustion chamber. Partially combusted fuel pellets can fall downward from the primary combustion chamber into the secondary combustion chamber onto the secondary grate, while intake air can flow rearward into the secondary combustion chamber, through the secondary grate, and upward into the primary combustion chamber. The secondary grate supports the partially combusted fuel pellets before they burn further and permits ash resulting from further combustion of the partially combusted fuel pellets to fall through the secondary grate and downward into the ash receptacle. Intake air can flow rearward into the ash receptacle and upward into the secondary combustion chamber.

The inventive apparatus can be incorporated into a pellet stove that can include a pellet feeder, one or more air intakes passages, and an exhaust gas conduit.

Objects and advantages pertaining to pellet stoves may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIGS. 2A, 2B, and 2C are side, front, and top views, respectively, of the example pellet stove.

The embodiments depicted are shown only schematically; all features may not be shown in full detail or in proper proportion; for clarity certain features or structures may be exaggerated or diminished relative to others or omitted entirely; the drawings should not be regarded as being to scale unless explicitly indicated as being to scale. The embodiments shown are only examples and should not be construed as limiting the scope of the present disclosure or appended claims.

DETAILED DESCRIPTION

It would be desirable to provide a pellet stove arranged so as to guide or enhance air flow through one or more combustion chambers. Such guided or enhanced air flow can result in one or more of improved stove efficiency, more complete combustion of the pellet fuel, or reduced particulate emission or ash residue.

Figure 1:
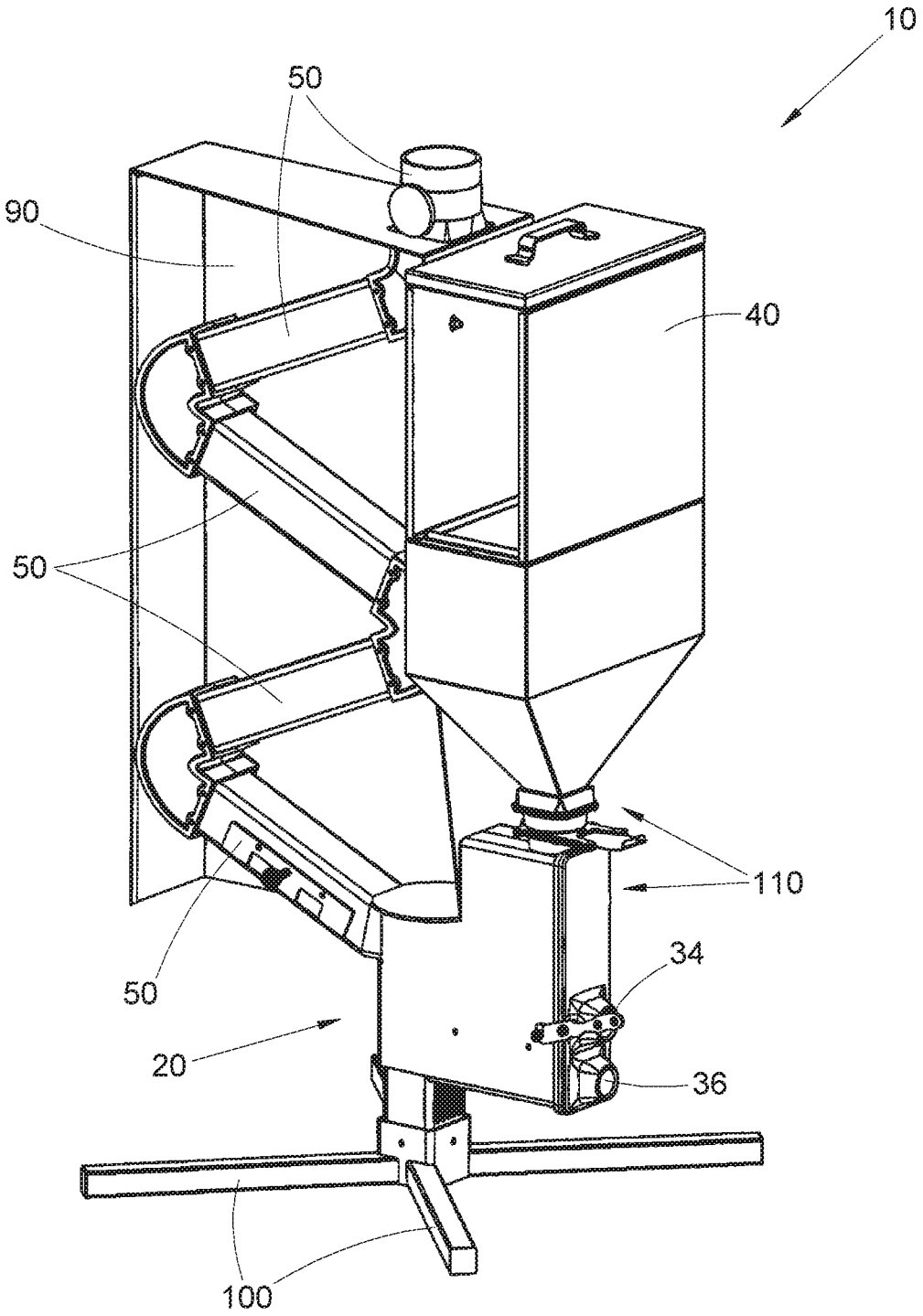
FIG. 1 is a perspective view of the general arrangement of an example pellet stove.
Figure 3:
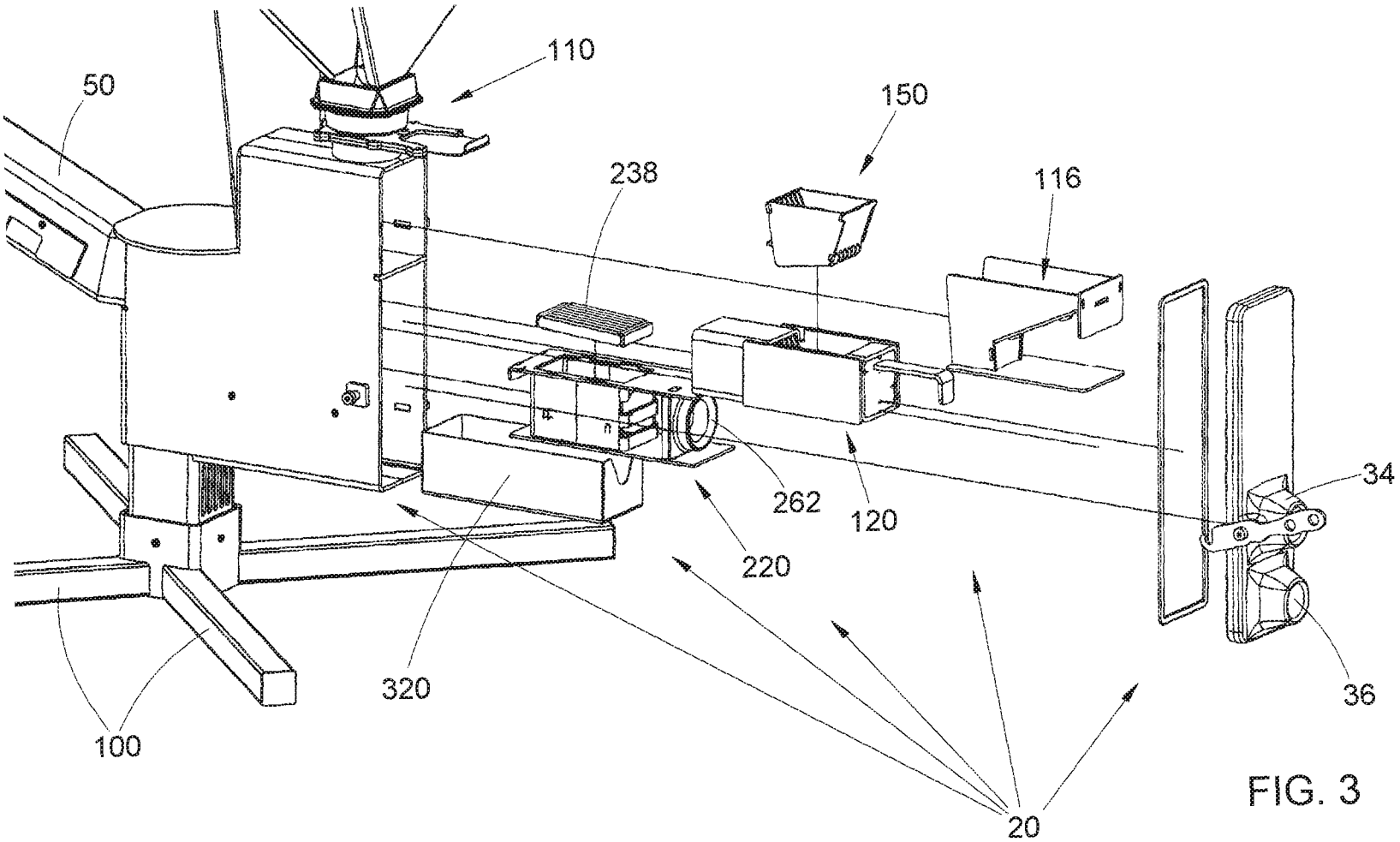
FIG. 3 is an exploded view of an example inventive combustion assembly of the example pellet stove.
Figure 4C:
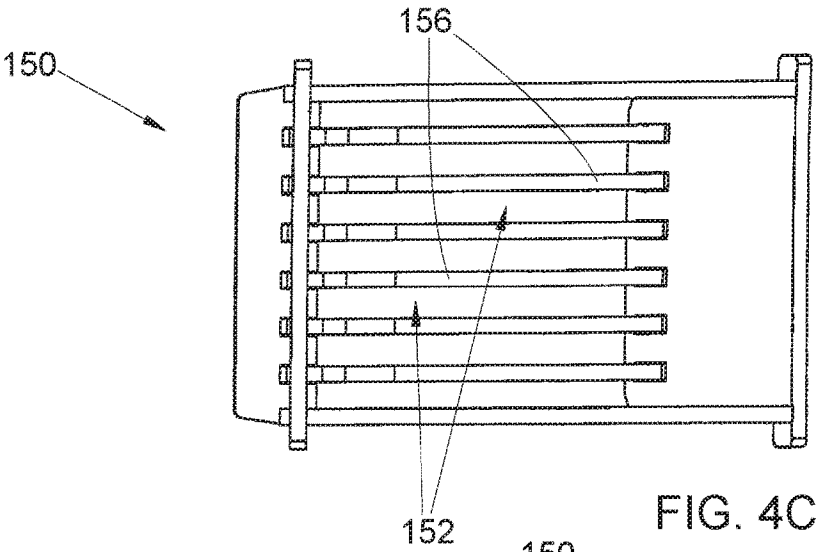
FIGS. 4A through 4F are rear, side, top, side cross sectional, perspective, and exploded views, respectively, of a burn basket insert of a primary burn chamber of the example inventive combustion assembly.
Figure 4B:
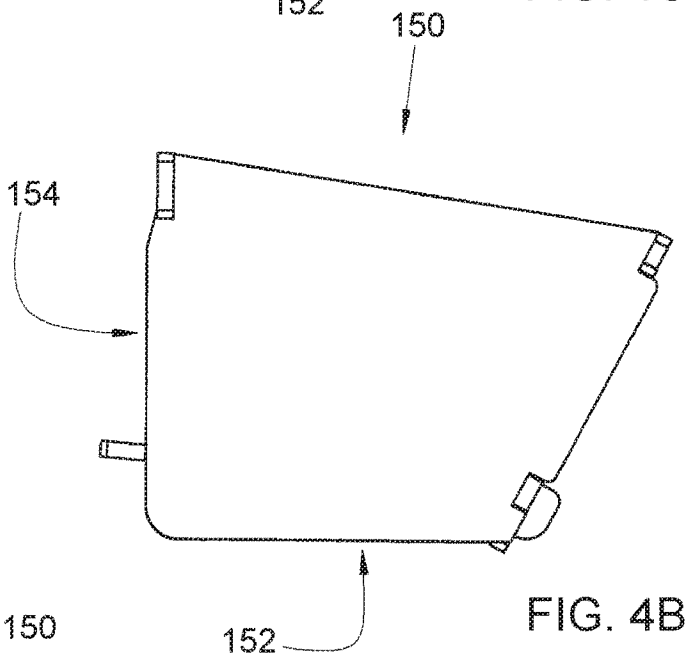
Figure 4A:
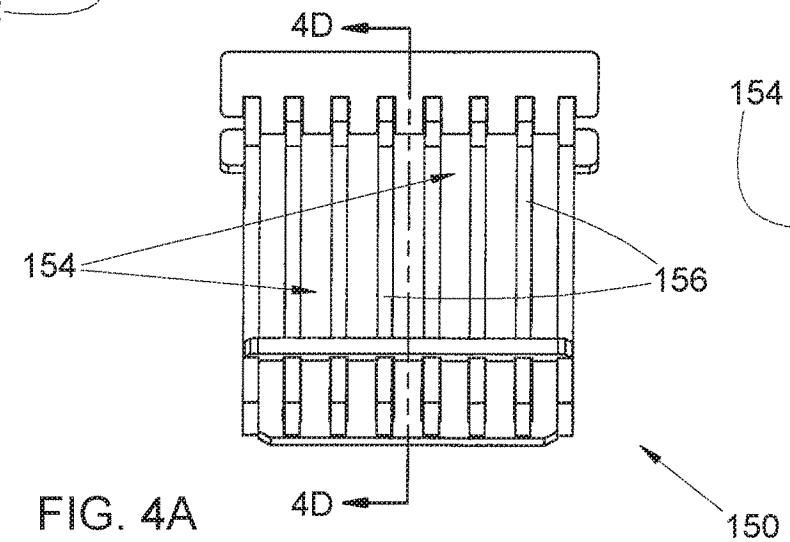
Figure 4D:
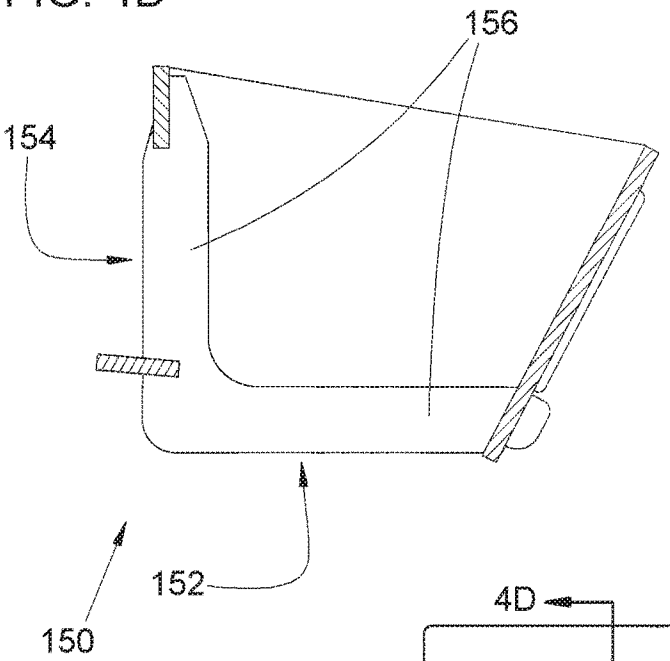
Figure 4F:
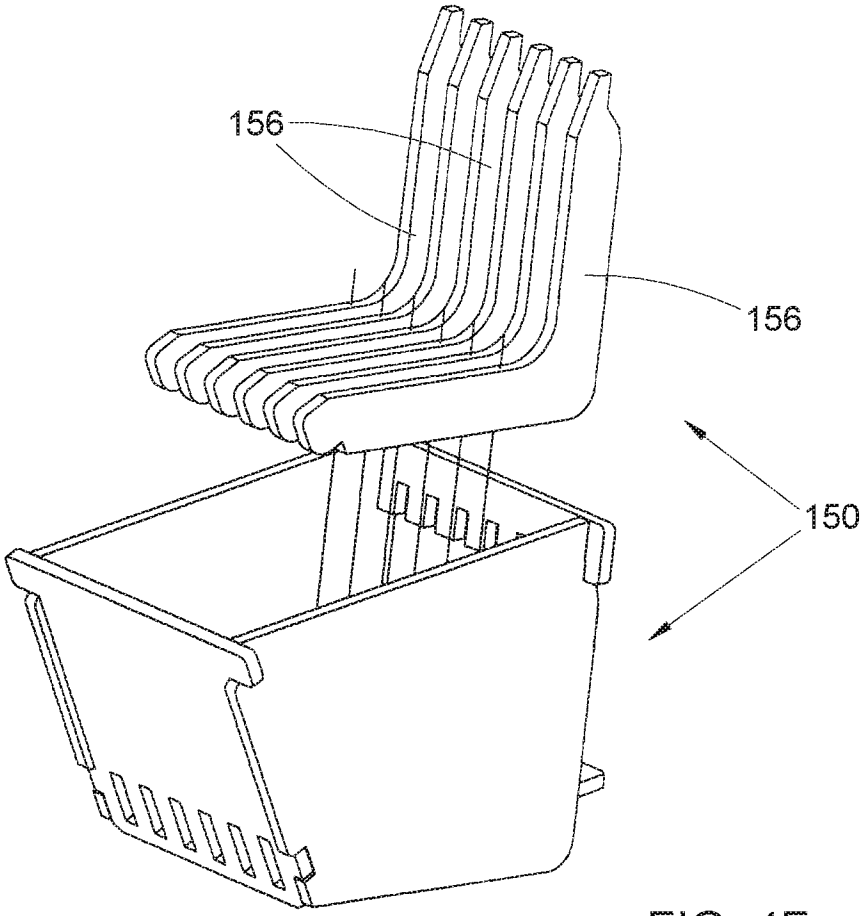
Figure 4E:
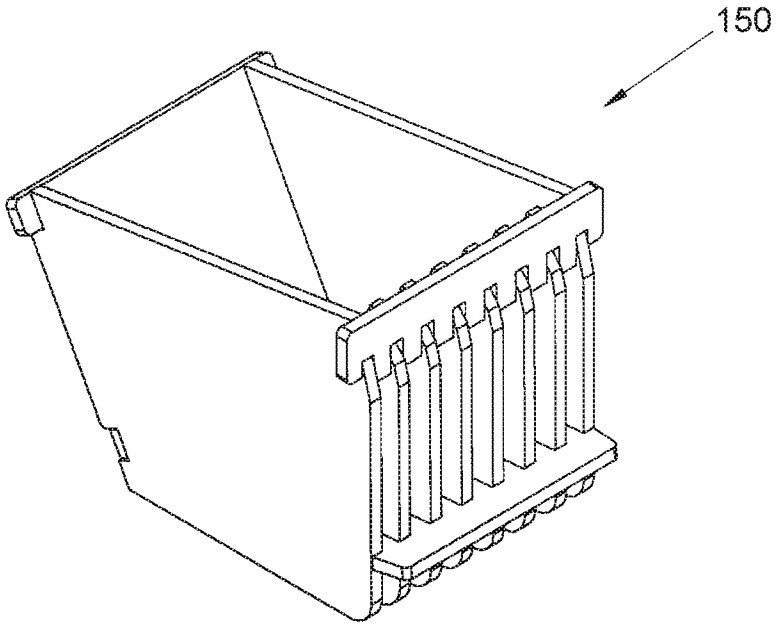
Figure 5:
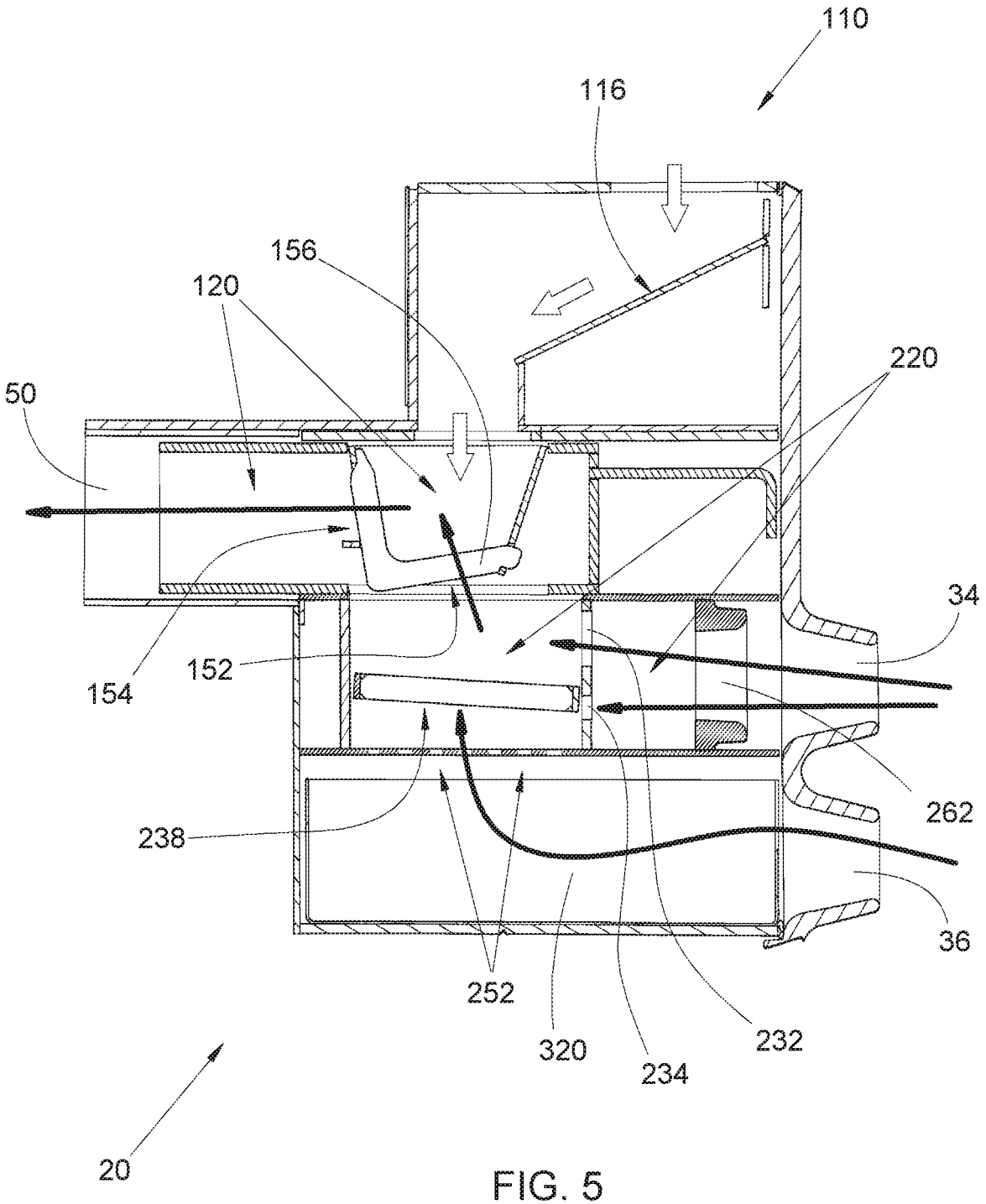
FIG. 5 is a side cross sectional view of the example inventive combustion assembly. Heavy black arrows indicate air or exhaust flow; hollow white arrows indicate fuel pellet movement.

A general arrangement of an example of a pellet stove 10 is shown in FIGS. 1, 2A/B/C, and 3. The pellet stove 10 includes a combustion assembly 20 that includes within a housing a primary combustion chamber 120, a secondary combustion chamber 220, and an ash receptacle 320. Air intake passages 34 and 36 can be located at a forward intake end of the housing, and an exhaust gas conduit 50 can be connected to a rearward exhaust end of the housing. A pellet feeder 110 can be positioned above the combustion assembly 20 housing and can include a sloped feeder surface 116. The pellet feeder 110 can feed fuel pellets directly into the primary combustion chamber 120; a pellet hopper 40 can be connected to the pellet feeder 110. The combustion assembly 20 can be supported by a stand 100, and the exhaust gas conduit 50 can be supported by a cabinet or housing 90. Note that the directions "forward" and "rearward" are designated arbitrarily and only for convenience of description, so that air and exhaust flow through the combustion assembly 20 is generally rearward.

In the cross section of FIG. 6 air and exhaust flows are indicated by the heavy black arrows, and fuel pellet movement is indicated by hollow white arrows. As shown, during operation of the pellet stove 10: (i) fuel pellets move downward through the pellet feeder 110 into the primary combustion chamber 120; (ii) intake air flows rearward into the combustion assembly 20 from outside the housing through the intake passages 34 and 36, rearward through the ash receptacle 320 and the secondary combustion chamber 220, and upward into the primary combustion chamber 120; (ii) exhaust gases flow rearward out of the primary combustion chamber 120 into the exhaust gas conduit 50. The exhaust gas conduit 50 transmits the exhaust gas along a tortuous path so as to radiate heat from the exhaust gas into a volume of space immediately surrounding the pellet stove 10.

An example of an inventive primary combustion chamber 120 is illustrated in FIGS. 3, 4A-4F, and 5, and includes a primary grate 152 and an exhaust grate 154. The primary combustion chamber 120 has a top opening through which fuel pellets fall downward into the primary combustion chamber 120 onto the primary grate 152. A bottom opening of the primary combustion chamber 120 can communicate with the secondary combustion chamber 220 and is at least partly obstructed by the primary grate 152. Intake air flows upward from the secondary combustion chamber 220 into the primary combustion chamber 120 through its bottom opening and through the primary grate 152. A rear opening of the primary combustion chamber 120 can communicate with the exhaust gas conduit 50 and is at least partly obstructed by the exhaust grate 154. Exhaust gas flows rearward out of the primary combustion chamber 120 through the exhaust grate 154 and through the rear opening. The primary grate 152 supports the fuel pellets before they partially burn, and permits partially combusted fuel pellets to fall through the primary grate 152. The primary grate 152 defines a primary grate surface with multiple generally vertical primary grate passages through the primary grate 152. Each of those primary grate passages is smaller in at least one transverse passage dimension than its vertical depth (i.e., defines an air flow channel that is longer than it is wide). It is believed that such an arrangement guides or enhances air flow through the primary combustion chamber 120, resulting in improved stove efficiency, more complete combustion of the pellet fuel, or reduced particulate emission or ash residue The primary grate passages can be of any suitable sizes, shapes, or dimensions. In some examples, the primary grate 152 comprises multiple elongated primary grate members arranged in a generally horizontal, generally parallel, spaced-apart arrangement. Generally horizontal can include primary grate surfaces tilted as much as ±15° or ±20.° from horizontal; a rearward tilt of about 5° to about 10.° is sometimes employed, as shown in the drawings. In examples including such elongated, spaced-apart primary grate members, the vertical primary grate passages are arranged as multiple parallel elongated primary slots, with each primary slot being vertically deeper than its width. In some such examples, the elongated slots are arranged in a generally forward-to-rearward orientation, further guiding and enhancing the generally upward and rearward air flow into and through the primary combustion chamber 120 (with the primary grate members acting as fixed vanes or louvers to guide or constrain the generally upward and rearward air flow).

In some examples the primary combustion chamber 120 can be less than about 3 inches wide (side to side); in some examples the primary combustion chamber 120 can be less than about 5 inches long (front to rear). In some examples each primary grate member is between about 0.05 and about 0.20 inches wide and between about 0.3 and about 1.0 inches high, and each primary slot is between about 0.20 and about 0.25 inches wide and between about 0.3 and about 1.0 inches deep. In some examples each primary grate member is about 0.12 inches wide and about 0.5 inches high, and each primary slot is about 0.24 inches wide and about 0.5 inches deep. In some examples a depth-to-width ratio of each secondary slot is between about 1.5 and about 4.0. In some examples a depth-to-width ratio of each secondary slot is between about 2.0 and about 2.5.

The exhaust grate 154 defines an exhaust grate surface with multiple rearward exhaust grate passages through the exhaust grate 154. In some examples, each exhaust grate passage can be smaller in at least one transverse passage dimension than its rearward length. Similar to the arrangement of the primary grate passages, it is believed that such an arrangement guides or enhances air flow through the primary combustion chamber 120. In some examples the exhaust grate 154 can include multiple elongated exhaust grate members arranged in a generally vertical (e.g., including exhaust grate surfaces tilted as much as ±15° or ±20.° from vertical; a rearward tilt of about 5° to about 10.° is sometimes employed), generally parallel, spaced-apart arrangement so that the rearward exhaust grate passages are arranged as multiple parallel elongated slots, with each slot being rearwardly deeper than its width (with the exhaust grate members acting as fixed vanes or louvers to guide or constrain the generally rearward air flow).

In some examples each exhaust grate member is between about 0.05 and about 0.20 inches wide and between about 0.3 and about 1.0 inches high, and each exhaust slot is between about 0.20 and about 0.25 inches wide and between about 0.3 and about 1.0 inches deep. In some examples each exhaust grate member is about 0.12 inches wide and about 0.5 inches high, and each exhaust slot is about 0.24 inches wide and about 0.5 inches deep. In some examples a depth-to-width ratio of each exhaust slot is between about 1.5 and about 4.0. In some examples a depth-to-width ratio of each exhaust slot is between about 2.0 and about 3.0.

In some examples, each exhaust grate member can be attached to or integrally formed with a corresponding one of the primary grate members to form a generally L-shaped grate member 156, as shown in the drawings. In some of those examples, each pair of primary/exhaust grate members can be substantially perpendicular to each other.

The secondary combustion chamber 220 can be positioned within the combustion assembly housing below the primary combustion chamber 120. The ash receptacle 320 can be positioned within the combustion assembly housing below the secondary combustion chamber 220. Partially combusted fuel pellets can fall downward from the primary combustion chamber 120 into the secondary combustion chamber 220 through an upper opening onto a secondary grate 238. Intake air can flow rearward into the secondary combustion chamber 220, through the secondary grate 238, and upward into the primary combustion chamber 120. The secondary grate 238 can support the partially combusted fuel pellets before they burn further, but permit ash resulting from that further burning of the partially combusted fuel pellets to fall through the secondary grate 238. The secondary grate 238 defines a secondary grate surface with multiple vertical secondary grate passages through it. In some examples, in an arrangement similar to that of the primary grate 152, each secondary grate passage can be smaller in at least one transverse passage dimension than its vertical depth. Similar to the arrangement of the primary grate passages, it is believed that such an arrangement guides or enhances air flow through the primary combustion chamber 120.

The secondary grate passages can be of any suitable sizes, shapes, or dimensions. In some examples, the secondary grate 154 can comprise multiple elongated secondary grate members arranged in a generally horizontal, generally parallel, spaced-apart arrangement. Generally horizontal can include secondary grate surfaces tilted as much as ±15° or ±20.° from horizontal; a forward tilt of about 3° to about 8° is sometimes employed, as shown in the drawings. In examples including such elongated, spaced-apart secondary grate members, the vertical primary grate passages are arranged as multiple parallel elongated slots, with each slot being vertically deeper than its width. In some such examples, the elongated slots are arranged in a generally forward-to-rearward orientation, further guiding and enhancing the generally rearward and upward air flow into and through the secondary combustion chamber 220 (with the secondary grate members acting as fixed vanes or louvers to guide or constrain the generally rearward and upward air flow).

In some examples the secondary combustion chamber 220 can be less than about 3 inches wide (side to side); in some examples the secondary combustion chamber 220 can be less than about 6 inches long (front to rear). In some examples each secondary grate member is between about 0.05 and about 0.20 inches wide and between about 0.3 and about 1.0 inches high, and each secondary slot is between about 0.15 and about 0.20 inches wide and between about 0.3 and about 1.0 inches deep. In some examples each secondary grate member is about 0.12 inches wide and about 0.5 inches high, and each secondary slot is about 0.19 inches wide and about 0.5 inches deep. In some examples a depth-to-width ratio of each secondary slot is between about 1.5 and about 4.0. In some examples a depth-to-width ratio of each secondary slot is between about 2.5 and about 3.0.

In some examples intake air can flow rearward through the secondary combustion chamber 220 both above and below the secondary grate 238. In the example shown, air passage 232 enable intake air to flow rearward from the air intake passage 34 through the secondary combustion chamber 220 above the secondary grate 238, and the air passage 234 enable intake air to flow rearward from the air intake passage 34 through the secondary combustion chamber 220 below the secondary grate 238 and then upward through the secondary grate 238. In some examples an air horn 262 can mate with an inner portion of the air intake passage 34. Intake air can also flow upward into the secondary combustion chamber 220 through a lower opening that communication with the ash receptacle 320.

Ash resulting from combustion of the fuel pellets on the secondary grate 238 can fall downward from the secondary combustion chamber 220 into the ash receptacle 320. Intake air can flow rearward into the ash receptacle 320 and upward into the secondary combustion chamber 220. A partition can separate the secondary combustion chamber 220 from the ash receptacle 320; a plurality of ash discharge openings 252 through the partition enable ash to fall downward from the secondary combustion chamber 220 into the ash receptacle 320 and intake air to flow upward from the ash receptacle 320 into the secondary combustion chamber 220. The ash discharge opening 252 can be of any suitable sizes, number, or arrangement, e.g., an array of rounded holes through the partition. Intake air can flow through the air intake passage 36, into and through the ash receptacle 320, and thence upward into the secondary combustion chamber 220.

The primary combustion chamber 120 and its grates 152 and 154, the secondary combustion chamber 220 and its grate 238, the ash receptacle 320, and other parts or components of the pellet stove 10 can be constructed in any suitable way using any suitable materials. Metals, metal alloys, ceramics, or other heat-resistant materials can be suitably employed. In some examples, including the example shown, the primary combustion chamber 120, the secondary combustion chamber 220, and the ash receptacle 320 are each removably insertable into the combustion chamber housing. Such an arrangement can facilitate easy cleaning, maintenance, or repair of the pellet stove. In the example shown the primary grate 152 and the exhaust grate 154 form part of a so-called burn basket 150 that is in turn inserted to form part of the primary combustion chamber 120. In other examples (not shown) one or more or all of the primary combustion chamber 120, the secondary combustion chamber 220, or the ash receptacle 320 can be permanently attached or mounted within the housing, or can be integrally formed within the housing.

In addition to the preceding, the following example embodiments fall within the scope of the present disclosure or appended claims:

Example 1. An apparatus comprising a primary combustion chamber including a primary grate and an exhaust grate, (i) the primary combustion chamber having a top opening, a bottom opening at least partly obstructed by the primary grate, and a rear opening at least partly obstructed by the exhaust grate, (ii) the primary combustion chamber being structured and arranged so as to enable fuel pellets to fall downward through the top opening into the primary combustion chamber onto the primary grate, intake air to flow upward into the primary combustion chamber through the bottom opening and the primary grate, and exhaust gas to flow rearward out of the primary combustion chamber through the exhaust grate and the rear opening, (iii) the primary grate being structured and arranged so as to support the fuel pellets before partial combustion thereof and to permit partially combusted fuel pellets to fall through the primary grate, (iv) the primary grate defining a primary grate surface with multiple generally vertical primary grate passages through the primary grate, each primary grate passage being smaller in at least one transverse passage dimension than a vertical depth thereof.

Example 2. The apparatus of Example 1 wherein the primary grate comprises multiple elongated primary grate members arranged in a generally horizontal, generally parallel, spaced-apart arrangement so that the vertical primary grate passages are arranged as multiple parallel elongated primary slots, with each primary slot being vertically deeper than a width thereof.

Example 3. The apparatus of Example 2 wherein the elongated primary slots of the primary grate are arranged in a generally forward-to-rearward orientation.

Example 4. The apparatus of any one of Examples 2 or 3 wherein the exhaust grate comprises multiple elongated exhaust grate members arranged in a generally vertical, generally parallel, spaced-apart arrangement so that the rearward exhaust grate passages are arranged as multiple parallel exhaust slots, with each exhaust slot being rearwardly deeper than a width thereof, and each exhaust grate member is attached to or integrally formed with a corresponding one of the primary grate members to form a generally L-shaped grate member.

Example 5. The apparatus of any one of Examples 2 through 4 wherein each primary grate member is between about 0.05 and about 0.20 inches wide and between about 0.3 and about 1.0 inches high, and each primary slot is between about 0.20 and about 0.25 inches wide and between about 0.3 and about 1.0 inches deep.

Example 6. The apparatus of any one of Examples 2 through 4 wherein each primary grate member is about 0.12 inches wide and about 0.5 inches high, and each primary slot is about 0.24 inches wide and about 0.5 inches deep.

Example 7. The apparatus of any one of Examples 2 through 6 wherein a depth-to-width ratio of each primary slot is between about 1.5 and about 4.0.

Example 8. The apparatus of any one of Examples 2 through 6 wherein a depth-to-width ratio of each primary slot is between about 2.0 and about 2.5.

Example 9. The apparatus of any one of Examples 1 through 8 wherein the primary combustion chamber is less than about 3 inches wide (side to side).

Example 10. The apparatus of any one of Examples 1 through 9 wherein the primary combustion chamber is less than about 6 inches long (front to rear).

Example 11. The apparatus of any one of Examples 1 through 10 wherein the exhaust grate defines an exhaust grate surface with multiple rearward exhaust grate passages therethrough, each exhaust grate passage being smaller in at least one transverse passage dimension than a rearward length thereof.

Example 12. The apparatus of Example 11 wherein the exhaust grate comprises multiple elongated exhaust grate members arranged in a generally vertical, generally parallel, spaced-apart arrangement so that the rearward exhaust grate passages are arranged as multiple parallel elongated exhaust slots, with each exhaust slot being rearwardly deeper than a width thereof.

Example 13. The apparatus of Example 12 wherein each exhaust grate member is between about 0.05 and about 0.20 inches wide and between about 0.3 and about 1.0 inches high, and each exhaust slot is between about 0.20 and about 0.25 inches wide and between about 0.3 and about 1.0 inches deep.

Example 14. The apparatus of Example 12 wherein each exhaust grate member is about 0.12 inches wide and about 0.5 inches high, and each exhaust slot is about 0.24 inches wide and about 0.5 inches deep.

Example 15. The apparatus of any one of Examples 12 through 14 wherein a depth-to-width ratio of each exhaust slot is between about 1.5 and about 4.0.

Example 16. The apparatus of any one of Examples 12 through 14 wherein a depth-to-width ratio of each exhaust slot is between about 2.0 and about 3.0.

Example 17. The apparatus of any one of Examples 1 through 16 further comprising: (a) a combustion assembly housing having a forward intake end and a rearward exhaust end, the primary combustion chamber being positioned within the combustion assembly housing; (b) a secondary combustion chamber positioned within the combustion assembly housing below the primary combustion chamber and having a secondary grate, (i) the secondary combustion chamber being structured and arranged so as to enable partially combusted fuel pellets to fall downward from the primary combustion chamber into the secondary combustion chamber onto the secondary grate and intake air to flow rearward into the secondary combustion chamber, through the secondary grate, and upward into the primary combustion chamber, (ii) the secondary grate being structured and arranged so as to support the partially combusted fuel pellets before further combustion thereof and to permit ash resulting from further combustion of the partially combusted fuel pellets to fall through the secondary grate; and (c) an ash receptacle positioned within the combustion assembly housing below the secondary combustion chamber, the ash receptacle being structured and arranged so as to enable ash to fall downward from the secondary combustion chamber into the ash receptacle and intake air to flow rearward into the ash receptacle and upward into the secondary combustion chamber.

Example 18. The apparatus of Example 17 wherein the secondary grate defines a secondary grate surface with multiple vertical secondary grate passages therethrough, each secondary grate passage being smaller in at least one transverse passage dimension than a vertical depth thereof.

Example 19. The apparatus of Example 18 wherein the secondary grate comprises multiple elongated secondary grate members arranged in a generally horizontal, generally parallel, spaced-apart arrangement so that the vertical secondary grate passages are arranged as multiple parallel elongated secondary slots, with each secondary slot being vertically deeper than a width thereof.

Example 20. The apparatus of Example 19 wherein the elongated secondary slots of the secondary grate are arranged in a generally forward-to-rearward orientation.

Example 21. The apparatus of any one of Examples 19 or 20 wherein each secondary grate member is between about 0.05 and about 0.20 inches wide and between about 0.3 and about 1.0 inches high, and each secondary slot is between about 0.15 and about 0.20 inches wide and between about 0.3 and about 1.0 inches deep.

Example 22. The apparatus of any one of Examples 19 or 20 wherein each secondary grate member is about 0.12 inches wide and about 0.5 inches high, and each secondary slot is about 0.19 inches wide and about 0.5 inches deep.

Example 23. The apparatus of any one of Examples 19 through 22 wherein a depth-to-width ratio of each secondary slot is between about 1.5 and about 4.0.

Example 24. The apparatus of any one of Examples 19 through 22 wherein a depth-to-width ratio of each secondary slot is between about 2.5 and about 3.0.

Example 25. The apparatus of any one of Examples 17 through 24 wherein the secondary combustion chamber is less than about 3 inches wide (side to side).

Example 26. The apparatus of any one of Examples 17 through 25 wherein the secondary combustion chamber is less than about 6 inches long (front to rear).

Example 27. The apparatus of any one of Examples 17 through 26 wherein the secondary combustion chamber is structured and arranged so as to enable intake air to flow rearward into the secondary combustion chamber both above and below the secondary grate.

Example 28. The apparatus of any one of Examples 17 through 27 further comprising a partition between the secondary combustion chamber and the ash receptacle, the partition having a plurality of ash discharge openings structured and arranged so as to enable ash to fall downward from the secondary combustion chamber into the ash receptacle and intake air to flow upward from the ash receptacle into the secondary combustion chamber.

Example 29. The apparatus of Example 28 wherein the plurality of ash discharge opening include an array of rounded holes through the partition.

Example 30. The apparatus of any one of Examples 17 through 29 wherein one or more or all of the primary combustion chamber, secondary combustion chamber, or ash receptacle are structured and arranged so as to be removably inserted into the combustion chamber housing.

Example 31. The apparatus of any one of Examples 17 through 30 further comprising: (f) a pellet feeder positioned above the combustion assembly housing, the pellet feeder being structured and arranged so as to feed pellets directly into the primary combustion chamber; (g) one or more air intake passages at the forward intake end of the combustion assembly housing that are structured and arranged so as to enable intake air to flow into the combustion assembly housing from outside the housing; and (h) an exhaust gas conduit at the rearward exhaust end of the combustion assembly housing that is structured and arranged so as to receive exhaust gas flowing out of the primary combustion chamber through the exhaust grate and transmit the received exhaust gas along a tortuous path so as to radiate heat from the exhaust gas into a volume of space immediately surrounding the apparatus.

Example 32. The apparatus of Example 31 wherein one of the one or more air intake passages is structured and arranged so as to enable intake air to flow rearward into the secondary combustion chamber.

Example 33. The apparatus of any one of Examples 31 or 32 wherein the secondary combustion chamber includes an air horn structured and arranged so as to mate with an inner portion of one of the one or more air intake passages.

Example 34. The apparatus of any one of Examples 31 through 33 wherein one of the one or more air intake passages is structured and arranged so as to enable intake air to flow into and through the ash receptacle and thence upward into the secondary combustion chamber.

Example 35. The apparatus any one of Examples 31 through 34 further comprising a pellet hopper connected to the pellet feeder.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Therefore, the present disclosure shall be construed as implicitly disclosing any embodiment having any suitable subset of one or more features—which features are shown, described, or claimed in the present application—including those subsets that may not be explicitly disclosed herein. A "suitable" subset of features includes only features that are neither incompatible nor mutually exclusive with respect to any other feature of that subset. Accordingly, the appended claims are hereby incorporated in their entirety into the Detailed Description, with each claim standing on its own as a separate disclosed embodiment. In addition, each of the appended dependent claims shall be interpreted, only for purposes of disclosure by said incorporation of the claims into the Detailed Description, as if written in multiple dependent form and dependent upon all preceding claims with which it is not inconsistent. It should be further noted that the cumulative scope of the appended claims can, but does not necessarily, encompass the whole of the subject matter disclosed in the present application.

The following interpretations shall apply for purposes of the present disclosure and appended claims. The words "comprising," "including," "having," and variants thereof, wherever they appear, shall be construed as open ended terminology, with the same meaning as if a phrase such as "at least" were appended after each instance thereof, unless explicitly stated otherwise. The article "a" shall be interpreted as "one or more" unless "only one," "a single," or other similar limitation is stated explicitly or is implicit in the particular context; similarly, the article "the" shall be interpreted as "one or more of the" unless "only one of the," "a single one of the," or other similar limitation is stated explicitly or is implicit in the particular context. The conjunction "or" is to be construed inclusively unless: (i) it is explicitly stated otherwise, e.g., by use of "either . . . or," "only one of," or similar language; or (ii) two or more of the listed alternatives are understood or disclosed (implicitly or explicitly) to be incompatible or mutually exclusive within the particular context. In that latter case, "or" would be understood to encompass only those combinations involving non-mutually-exclusive alternatives. In one example, each of "a dog or a cat," "one or more of a dog or a cat," and "one or more dogs or cats" would be interpreted as one or more dogs without any cats, or one or more cats without any dogs, or one or more of each. In another example, each of "a dog, a cat, or a mouse," "one or more of a dog, a cat, or a mouse," and "one or more dogs, cats, or mice" would be interpreted as (i) one or more dogs without any cats or mice, (ii) one or more cats without and dogs or mice, (iii) one or more mice without any dogs or cats, (iv) one or more dogs and one or more cats without any mice, (v) one or more dogs and one or more mice without any cats, (vi) one or more cats and one or more mice without any dogs, or (vii) one or more dogs, one or more cats, and one or more mice. In another example, each of "two or more of a dog, a cat, or a mouse" or "two or more dogs, cats, or mice" would be interpreted as (i) one or more dogs and one or more cats without any mice, (ii) one or more dogs and one or more mice without any cats, (iii) one or more cats and one or more mice without and dogs, or (iv) one or more dogs, one or more cats, and one or more mice; "three or more," "four or more," and so on would be analogously interpreted.

For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, third, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. An apparatus comprising a primary combustion chamber including a primary grate and an exhaust grate, (i) the primary combustion chamber having a top opening, a bottom opening at least partly obstructed by the primary grate, and a rear opening at least partly obstructed by the exhaust grate, (ii) the primary combustion chamber being structured and arranged so as to enable fuel pellets to fall downward through the top opening into the primary combustion chamber onto the primary grate, intake air to flow upward into the primary combustion chamber through the bottom opening and the primary grate, and exhaust gas to flow rearward out of the primary combustion chamber through the exhaust grate and the rear opening, (iii) the primary grate being structured and arranged so as to support the fuel pellets before partial combustion thereof and to permit partially combusted fuel pellets to fall through the primary grate, (iv) the primary grate defining a primary grate surface with multiple generally vertical primary grate passages through the primary grate, each primary grate passage being smaller in at least one transverse passage dimension than a vertical depth thereof, (v) the exhaust grate defining an exhaust grate surface with multiple rearward exhaust grate passages therethrough, each exhaust grate passage being smaller in at least one transverse passage dimension than a rearward length thereof.

2. The apparatus of claim 1 wherein the primary grate comprises multiple elongated primary grate members arranged in a generally horizontal, generally parallel, spaced-apart arrangement so that the vertical primary grate passages are arranged as multiple parallel elongated primary slots, with each primary slot being vertically deeper than a width thereof.

3. The apparatus of claim 2 wherein the elongated primary slots of the primary grate are arranged in a generally forward-to-rearward orientation.

4. The apparatus of claim 2 wherein each primary grate member is between about 0.05 and about 0.20 inches wide and between about 0.3 and about 1.0 inches high, and each primary slot is between about 0.20 and about 0.25 inches wide and between about 0.3 and about 1.0 inches deep.

5. The apparatus of claim 2 wherein a depth-to-width ratio of each primary slot is between about 1.5 and about 4.0.

6. The apparatus of claim 1 wherein the exhaust grate comprises multiple elongated exhaust grate members arranged in a generally vertical, generally parallel, spaced-apart arrangement so that the rearward exhaust grate passages are arranged as multiple parallel elongated exhaust slots, with each exhaust slot being rearwardly deeper than a width thereof.

7. The apparatus of claim 6 wherein each exhaust grate member is between about 0.05 and about 0.20 inches wide and between about 0.3 and about 1.0 inches high, and each exhaust slot is between about 0.20 and about 0.25 inches wide and between about 0.3 and about 1.0 inches deep.

8. The apparatus of claim 6 wherein a depth-to-width ratio of each exhaust slot is between about 1.5 and about 4.0.

9. The apparatus of claim 1 further comprising:

(a) a combustion assembly housing having a forward intake end and a rearward exhaust end, the primary combustion chamber being positioned within the combustion assembly housing;

(b) a secondary combustion chamber positioned within the combustion assembly housing below the primary combustion chamber and having a secondary grate, (i) the secondary combustion chamber being structured and arranged so as to enable partially combusted fuel pellets to fall downward from the primary combustion chamber into the secondary combustion chamber onto the secondary grate and intake air to flow rearward into the secondary combustion chamber, through the secondary grate, and upward into the primary combustion chamber, (ii) the secondary grate being structured and arranged so as to support the partially combusted fuel pellets before further combustion thereof and to permit ash resulting from further combustion of the partially combusted fuel pellets to fall through the secondary grate; and (c) an ash receptacle positioned within the combustion assembly housing below the secondary combustion chamber, the ash receptacle being structured and arranged so as to enable ash to fall downward from the secondary combustion chamber into the ash receptacle and intake air to flow rearward into the ash receptacle and upward into the secondary combustion chamber.

10. The apparatus of claim 9 wherein the secondary grate defines a secondary grate surface with multiple vertical secondary grate passages therethrough, each secondary grate passage being smaller in at least one transverse passage dimension than a vertical depth thereof.

11. The apparatus of claim 10 wherein the secondary combustion chamber is structured and arranged so as to enable intake air to flow rearward into the secondary combustion chamber both above and below the secondary grate.

12. The apparatus of claim 10 wherein the secondary grate comprises multiple elongated secondary grate members arranged in a generally horizontal, generally parallel, spaced-apart arrangement so that the vertical secondary grate passages are arranged as multiple parallel elongated secondary slots, with each secondary slot being vertically deeper than a width thereof.

13. The apparatus of claim 12 wherein the elongated secondary slots of the secondary grate are arranged in a generally forward-to-rearward orientation.

14. The apparatus of claim 12 wherein each secondary grate member is between about 0.05 and about 0.20 inches wide and between about 0.3 and about 1.0 inches high, and each secondary slot is between about 0.15 and about 0.20 inches wide and between about 0.3 and about 1.0 inches deep.

15. The apparatus of claim 12 wherein a depth-to-width ratio of each secondary slot is between about 1.5 and about 4.0.

16. The apparatus of claim 9 further comprising a partition between the secondary combustion chamber and the ash receptacle, the partition having a plurality of ash discharge openings structured and arranged so as to enable ash to fall downward from the secondary combustion chamber into the ash receptacle and intake air to flow upward from the ash receptacle into the secondary combustion chamber.

17. The apparatus of claim 9 wherein one or more or all of the primary combustion chamber, secondary combustion chamber, or ash receptacle are structured and arranged so as to be removably inserted into the combustion chamber housing.

18. The apparatus of claim 9 further comprising:

(d) a pellet feeder positioned above the combustion assembly housing, the pellet feeder being structured and arranged so as to feed pellets directly into the primary combustion chamber;

(e) one or more air intake passages at the forward intake end of the combustion assembly housing that are structured and arranged so as to enable intake air to flow into the combustion assembly housing from outside the housing; and (f) an exhaust gas conduit at the rearward exhaust end of the combustion assembly housing that is structured and arranged so as to receive exhaust gas flowing out of the primary combustion chamber through the exhaust grate and transmit the received exhaust gas along a tortuous path so as to radiate heat from the exhaust gas into a volume of space immediately surrounding the apparatus.

19. The apparatus of claim 18 wherein one of the one or more air intake passages is structured and arranged so as to enable intake air to flow rearward into the secondary combustion chamber.

20. The apparatus of claim 18 wherein one of the one or more air intake passages is structured and arranged so as to enable intake air to flow into and through the ash receptacle and thence upward into the secondary combustion chamber.

* * * * *